US009187156B2

(12) United States Patent
Liu

(10) Patent No.: US 9,187,156 B2
(45) Date of Patent: Nov. 17, 2015

(54) MOBILE SYSTEM AND METHOD FOR FLUID TRANSFER INVOLVING SHIPS

(71) Applicant: Xuejie Liu, Katy, TX (US)

(72) Inventor: Xuejie Liu, Katy, TX (US)

( * ) Notice: Subject to any disclaimer, the term of this patent is extended or adjusted under 35 U.S.C. 154(b) by 0 days.

(21) Appl. No.: 14/532,332

(22) Filed: Nov. 4, 2014

(65) Prior Publication Data

US 2015/0166148 A1 Jun. 18, 2015

Related U.S. Application Data

(60) Provisional application No. 61/917,873, filed on Dec. 18, 2013.

(51) Int. Cl.
*B63B 27/24* (2006.01)

(52) U.S. Cl.
CPC ..... *B63B 27/24* (2013.01)

(58) Field of Classification Search
CPC ..... B63B 22/021; B63B 22/023; B63B 27/24
USPC ..... 135/355.12, 355.16, 355.17, 355.26, 135/899.2; 441/4; 114/230.1, 230.23, 264
See application file for complete search history.

(56) References Cited

U.S. PATENT DOCUMENTS 3,422,838 A * 1/1969 Headrick ..... B64D 37/005 137/355.12
3,735,435 A * 5/1973 Mikulicic ..... F16L 39/04 441/5
3,742,536 A * 7/1973 Sada ..... B63B 22/021 137/236.1
3,913,157 A * 10/1975 Versluis ..... B63B 22/021 137/236.1
4,436,048 A * 3/1984 Gentry ..... B63B 21/508 114/230.12
5,803,779 A 9/1998 Horton, III
6,338,505 B1 * 1/2002 Korsgaard ..... B63B 22/021 141/230
6,427,617 B1 8/2002 Breivik et al.
6,886,611 B2 5/2005 Dupont et al.
6,994,506 B2 * 2/2006 de Baan ..... B63B 27/24 137/355.24
7,179,144 B2 2/2007 De Baan
7,299,835 B2 11/2007 Dupont et al.
7,438,617 B2 * 10/2008 Poldervaart ..... B63B 22/021 114/230.1
7,836,840 B2 11/2010 Ehrhardt et al.
8,286,678 B2 10/2012 Adkins et al.
8,783,597 B2 * 7/2014 Nagler ..... B65H 75/4407 137/355.12
8,991,325 B2 * 3/2015 Yemm ..... B63B 21/16 114/230.12
2013/0240085 A1 9/2013 Hallot et al.
2014/0027008 A1 1/2014 Liem et al.
2014/0290779 A1 * 10/2014 Boudoin ..... B63B 27/24 137/899.2

* cited by examiner

*Primary Examiner* — Joshua Kennedy

(57) ABSTRACT

A mobile system for fluid transfer between a ship and a second location separated by a body of water, comprises a reel with at least two collecting areas, a coupler anchored to the reel with one opening at each collecting area and open towards a winding direction, a first hose extending from one opening to the ship, a second hose extending from the other opening to the second location, and a driving means to apply torques on the reel along the reel axis. When fluid transfer is over, the driving means turns the reel opposite to the winding direction, and both first hose and second hose are wound up in the collecting areas. The mobile transfer system is then ready for storage or for a subsequent fluid transfer elsewhere.

33 Claims, 14 Drawing Sheets

FIG. 1C
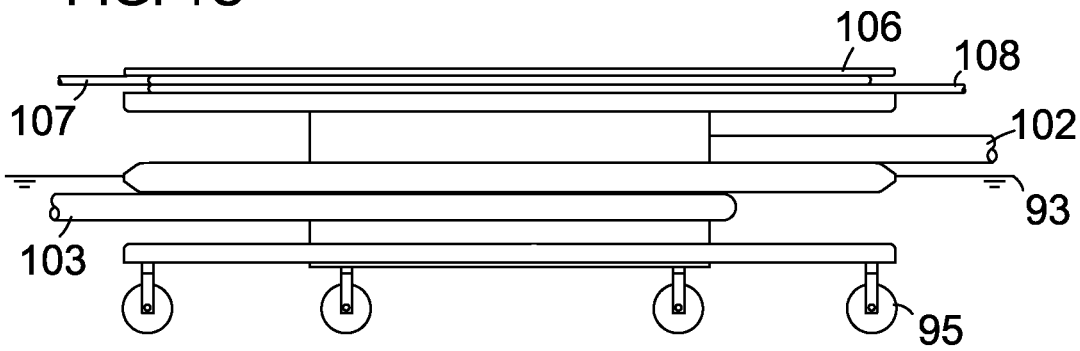
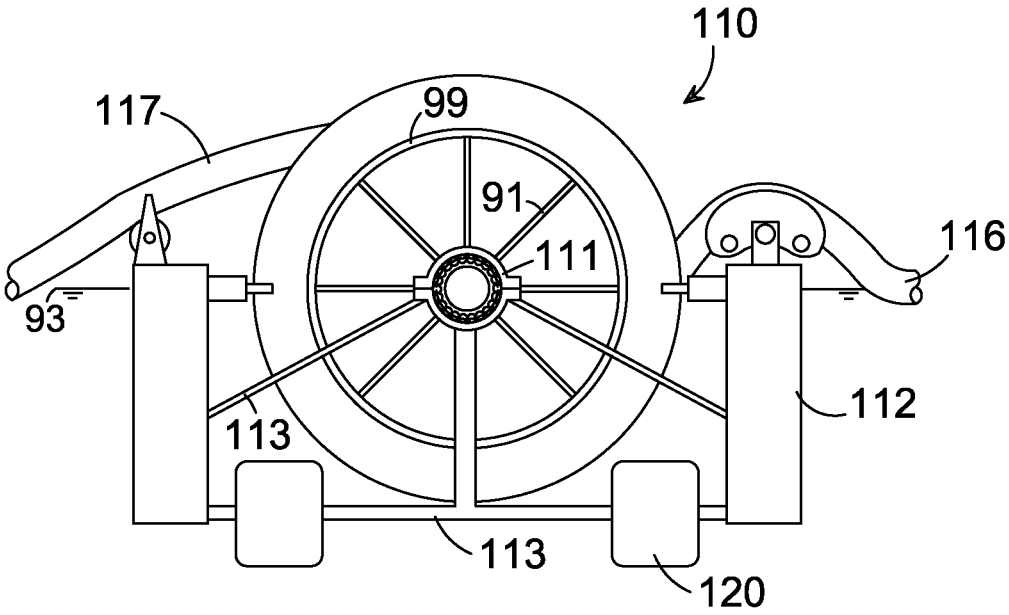
FIG. 2A

MOBILE SYSTEM AND METHOD FOR FLUID TRANSFER INVOLVING SHIPS

CROSS-REFERENCE TO RELATED APPLICATIONS

This application claims priority of U.S. Provisional Patent Application Ser. No. 61/917,873 filed on Dec. 18, 2013.

| U.S. Patent Documents | | | |
|---|---|---|---|
| 5,803,779 | September 1998 | Horton | 441/4 |
| 6,427,617 | August 2002 | Breivik et al | 114/230.1 |
| 6,719,008 | April 2004 | LeDevehat | 137/615 |
| 6,886,611 | May 2005 | Dupont and Paquet | 141/279 |
| 7,179,144 | February 2007 | De Baan | 441/5 |
| 7,299,835 | November 2007 | Dupont et al | 141/382 |
| 7,438,617 | October 2008 | Poldervaart et al | 441/5 |
| 7,836,840 | November 2010 | Ehrhardt et al | 114/230.13 |
| 7,857,001 | December 2010 | Kristensen | 137/615 |
| 8,286,678 | October 2012 | Adkins et al | 141/387 |
| 2013/0240085 | September 2013 | Hallot et al | 141/311 |
| 2014/0027008 | January 2014 | Liem et al | 141/1 |

STATEMENT REGARDING FEDERALLY SPONSORED RESEARCH OR DEVELOPMENT

Not Applicable

BACKGROUND OF THE INVENTION

1. Field of Invention

The present invention relates generally to fluid transfer between a ship and a second location. Specifically, the present invention provides a mobile transfer system with hoses in pair being pulled out simultaneously from a reel to form a fluid path. During non-transfer periods, hoses are wound up around the reel for storage.

2. Description of the Related Art

Floating production has been widely used for processing and storing hydrocarbon fluids on a vessel that is stationed near a field. A tanker is used to transport the fluids to terminals near users. In this case, a loading system is needed to transfer the fluids from a production vessel to a tanker. In other cases, fluids need to be transferred from a service vessel to a drilling vessel, from a fuel barge to a ship, from a large vessel to a small vessel (lightering), between an onshore facility and a ship, from a suction vessel to shore in hydraulic dredge, etc. In a benign environment, a vessel is moored to another vessel or dolphins side by side. Fluids are transferred through the middle-ship manifolds with either air hoses (i.e., hoses suspended in air) or hard arms. To enhance safety, a certain distance (e.g., 60 to 120 m) is needed especially for vessels docked in a harsh environment. One way is to dock two vessels in a tandem configuration. Another way is to install a floating buoy moored at a single-point (SPM) with a turntable on top. The buoy is stationed at a distance from a production vessel, a tanker is moored to the buoy with a hawser. In both ways, the tanker can re-orientate automatically in alignment with a wind/current direction.

As an alternative to ports, a SPM buoy has been used in shallow water for fluid transfer between a tanker and an onshore facility with a riser and a subsea pipeline extending from the buoy to shore. A buoy (e.g., floating cans) has also been used for fluid transfer between wells and a FPSO where a riser extends from the buoy to the wells. When used for deepwater field development, a buoy can be located at a few hundreds meters under the sea surface and hold a riser below with buoyancy.

Floating hoses are also used for fluid transfer between a stationary vessel and tanker or between a SPM buoy and tanker. A current practice is supporting a reel/wheel on a stationary vessel or station, and pulling one end of hose from the reel over to a tanker. After fluid transfer, the hose is reeled back to the reel. This system requires a swivel joint at a reel axle between the rotating reel and fixed piping on the station. When a SPM buoy is used, a hose is freely floating in water. A floating hose left in water is subjected to potential damage caused by a third party or storms. Alternatively, the hose can be wound around a reel that is rotatable to its base anchored to the seabed as disclosed in U.S. Pat. No. 7,438,617 to Poldervaart et al., but this requires significant changes to an existing SPM buoy. Alternatively, U.S. Pat. No. 7,836,840 to Ehrhardt et al discloses a submersible turret that is connected to a socket at a ship bottom. The drawback of this system is the need for significant changes to existing tankers.

In order to save space on a production vessel, many solutions have been proposed. For example, US application No. 2013/0240085 to Hallot et al discloses multiple reels stocked up on top of each other aboard a production vessel, and floating hoses are wound around the reels after fluid transfer. U.S. Pat. No. 8,286,678 to Adkins et al discloses a transfer vessel with submerged conduits freely hung between a production vessel and the transfer vessel. U.S. Pat. No. 6,427,617 to Breivik et al discloses a floating hose with a swivel at one end and the hose is stored above water along a hull side. U.S. Pat. No. 5,803,779 to Horton discloses a transfer system having two reels on a buoy along with two swivel joints and three hoses. That is, one hose extends from one reel to a production vessel, another hose extends from the other reel to a tanker, and a third hose (or conduit) is used for fluid connection between two axles of reels. All these systems require swivel joints.

Therefore it is desirable to have a universal transfer system without swivel joints for fluid transfer between a ship and a second location (including a station) separated at a wide range of distances.

BRIEF SUMMARY OF THE INVENTION

The present invention provides a mobile transfer system between a ship and a second location separated by a body of water. The mobile transfer system comprises a reel having a drum and a plurality of flanges, a first hose and a second hose and a driving means to turn the reel. The first hose and second hose are fluidly connected with each other at the drum with a coupler. Both hoses are wound around the drum in one winding direction (either clockwise or counter-clockwise), but around different collecting areas. During fluid transfer, the external end of the second hose is in fluid communication with the second location while the external end of the first hose is in fluid communication with the ship. With a torque applied at the reel by a pair of ropes or motors, both hoses are in tension with the reel being located in the middle. Once a loading operation is over, rotate the reel opposite to the winding direction and collect both hoses around the reel simultaneously.

In one embodiment, hoses are wound around a reel that remains standing with a reel axis perpendicular to a water surface. In another embodiment, hoses are wound around a reel that remains lying with a reel axis parallel to a water surface. Buoyancy devices are preferably evenly distributed around the reel to keep the reel afloat in water and to maintain its proper orientation. The buoyancy devices include close-cell foams and air-filled containers such as bags, bottles, hollow balls, tubes, pipes, boxes or other shaped containers made of polymer. Air-filled metal containers such as steel cans or boxes may be used as well to provide buoyancy.

Storing a mobile transfer system at a stationary facility is preferred when conditions allow. For a stationary vessel, the system is docked behind a stern for protection with a second hose fluidly connected to a stationary vessel. When a tanker comes, pull the external end of a first hose over with ropes and make fluidly connection with tanker manifolds. Once fluid transfer is over, disconnect the first hose from the tanker and rotate the reel opposite to the winding direction. The hoses are collected and the reel is automatically dragged back to the stationary vessel. The system is then ready for subsequent transfer operations. In case of extreme weather, the system can be towed to a harbor or dry ground.

The second location can be either an onshore site or an offshore site. It includes a facility such as a fuel truck, a fuel barge, a drilling vessel, a Floating Production vessel such as FLNG (Floating Liquefied Natural Gas) and FPSO (Storage and Offloading), a regasification vessel, a SPM (Single Point Mooring) buoy with or without a turntable, a fixed platform at a terminal or GBS (Gravity Based Storage offshore), a floating platform, a pipeline end manifold/tie-in located onshore or offshore, and a suction header. The ship can be any tankers, service vessels, any ships that use hydrocarbons as bunker fuels, suction vessels for muds, etc. The hose can be any flexible tube or conduit that can be easily reeled with a minimum bending radius preferably less than 3 m. The hose includes a plastic tube (collapsible or non-collapsible), a metal bellow hose, a composite tube made of plastic and metal, a hose-in-hose and a hose bundle.

Accordingly, it is a principal object of the invention to provide a swivel-free transfer system that can not only be used in a harsh environment, but also apply for a wide range of separation distances (e.g., from 5 to 500 meters) between a ship and a second location.

It is another object of the invention to provide a transfer system between a ship and an onshore facility.

It is another object of the invention to provide a mobile transfer system that can be relocated for protection or for fluid transfer at multiple sites.

It is another object of the invention to provide a transfer system that requires minimum modification to existing vessels or facilities.

It is another object of the invention to provide a transfer system applicable for any fluids or products that are flowable, including cryogenic fluids.

BRIEF DESCRIPTION OF THE DRAWINGS

The system and advantages of the present invention will be better understood by referring to the drawings, in which:

FIG. 1A, FIG. 1B and FIG. 1C are a first embodiment of the invention with one flow path in which FIG. 1A is a top view, FIG. 1B is a cross-section view and FIG. 1C is an elevation view;

FIG. 2A and FIG. 2B are a second embodiment of the invention with two flow paths, in which FIG. 2A is an elevation view and FIG. 2B is a top view;

FIG. 3A and FIG. 3B are a third embodiment of the invention with one and half flow paths, in which FIG. 3A is an elevation view and FIG. 3B is a cross-section view;

FIG. 4A and FIG. 4B are a fourth embodiment of the invention with two pairs of hose bundles in which FIG. 4A is an elevation view and FIG. 4B is a cross-section view;

(FIG. 8A is an elevation view and FIG. 8B is a top view);

FIG. 12A is an elevation view of the system being elevated above water in a loading position, while

DETAILED DESCRIPTION OF THE PREFERRED EMBODIMENT

Figure 1A:
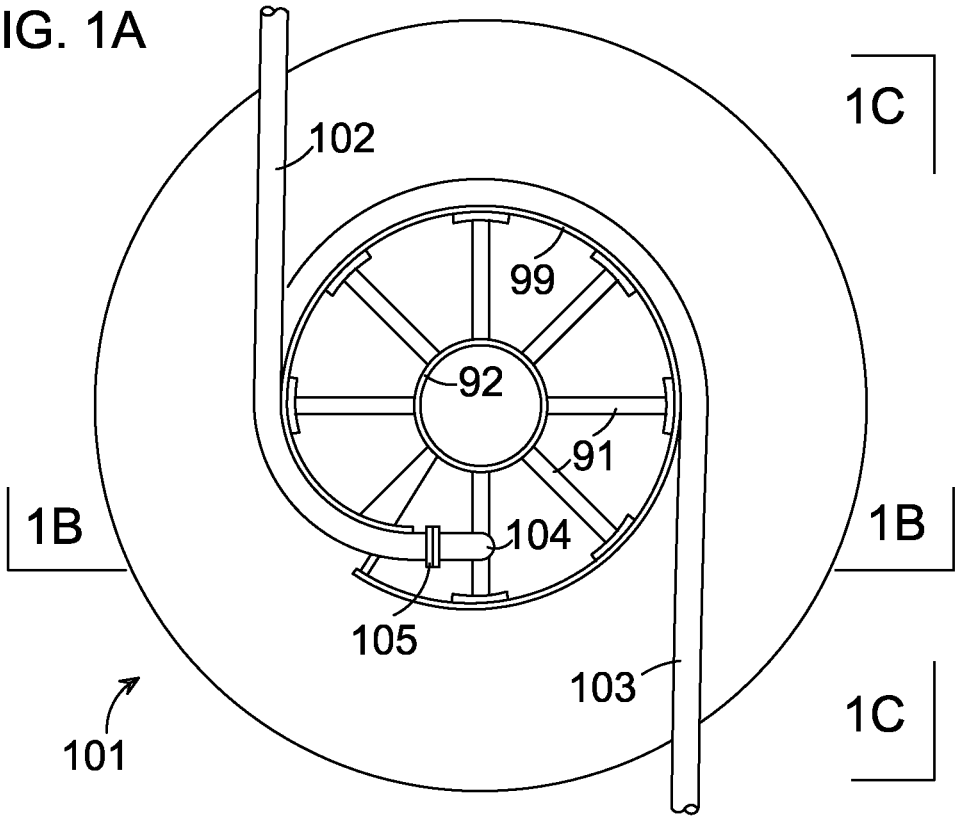
Figure 1B:
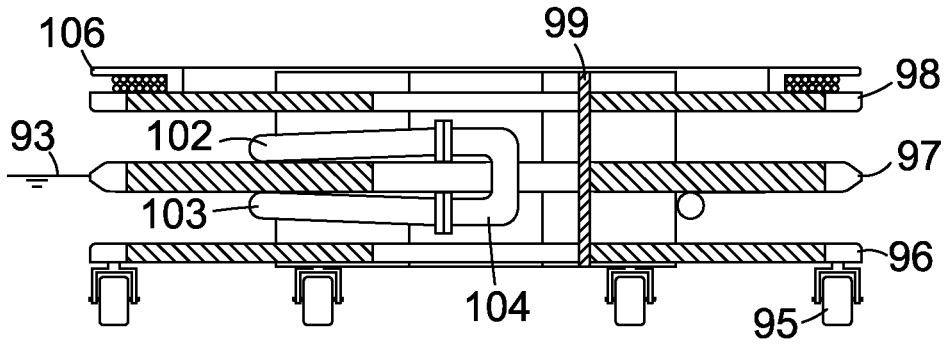

A first embodiment of the present invention is illustrated in FIG. 1A, FIG. 1B and FIG. 1C. A standing reel 101 is floating in water with its axis perpendicular to a water surface 93. The standing reel 101 has a drum 99 in the center with three flanges anchored around. A top collecting area is formed between a top flange 98 and middle flange 97 while a bottom collecting area is between middle flange 97 and bottom flange 96. In another word, middle flange 97 serves as a partition separating a drum surface into two collecting areas. Wheels 95 are attached to the bottom of bottom flange 96. A hub 92 and spokes 91 are used to strengthen standing reel 101 against hydrodynamic forces (e.g., ocean waves), preferably located at the top and bottom of drum 99.

A coupler 104 is anchored to drum 99. Coupler 104 has two openings facing a clockwise winding direction with one opening located at the top collecting area (e.g., first collecting area) and one opening at the bottom collecting area (e.g., a second collecting area). A top hose 102 is wound clockwise around the top collecting area with an internal end fluidly connected to the coupler 104 and an external end readily accessible. A bottom hose 103 is wound clockwise around the bottom collecting area with an internal end fluidly connected to coupler 104 (e.g., with an end flange 105) and an external end readily accessible. In another word, the top hose 102 and bottom hose 103 are fluidly connected around the drum at the internal ends and leave the external ends around the outer edge of wound hose rings in the top collecting area and bottom collecting area respectively. When the external ends are pulled from an opposite direction (e.g., one pulled from the south and the other pulled from the north), the standing reel 101 will rotate clockwise and stay in the middle with a flow path established along a north-south direction.

A number of angles 106 are anchored to the top surface of top flange 98 circumferentially to form a third collecting area for ropes. A top rope 107 and a bottom rope 108 (FIG. 1C) are tied to a short leg of angles 106 at inner ends and wound around short legs counterclockwise, and leave outer ends atop the edge of top flange 98. When the outer ends are pulled from an opposite direction (e.g., one pulled from the south and the other pulled from the north), the standing reel 101 will rotate counterclockwise and stay in the middle of ropes with two ropes lined up along a north-south direction. With a pair of ropes (107 and 108) and a pair of hoses (102 and 103) wound in opposite directions around the same drum, when ropes are pulled by outer ends, hoses are wound-up. When hoses are pulled by the external ends, the ropes are wound-up. Alternatively, a fourth flange can replace the angles 106 and be added on the top of top flange 98 and form a rope collecting area along with the top flange 98 and drum 99. Alternatively, ropes can be wound around a groove at the outer edge of top flange 98 (Refer to FIG. 3B).

Figure 3A:
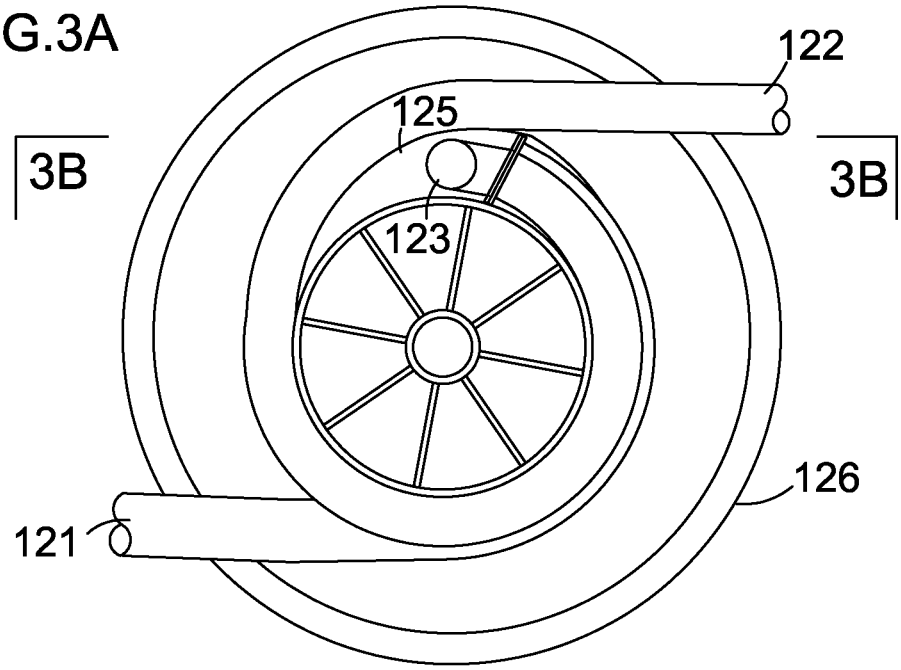

The drum 99 has a radius larger than the minimum bending radius of hoses. Three flanges (98, 97 and 96) have a sufficient size to support and protect the hoses. In FIG. 1B, the end flange 105 and coupler 104 are located inside the drum 99. Alternatively, coupler 104 can be located on the surface of drum 99 (as shown in FIG. 3A) with drum 99 in a complete cylinder shape.

To keep the reel afloat, buoyancy devices such as light materials or air-filled containers can be located inside the drum 99 or around the flanges. With an even distribution, the reel remains standing at all time. With a water surface 93 around the middle flange 97, top hose 102 rests on the middle flange 97 by weight, and bottom hose 103 also leans against middle flange 97 due to buoyancy from a light hose. Wheels 95 allow standing reel 101 and hoses to be towed onshore.

Figure 2B:
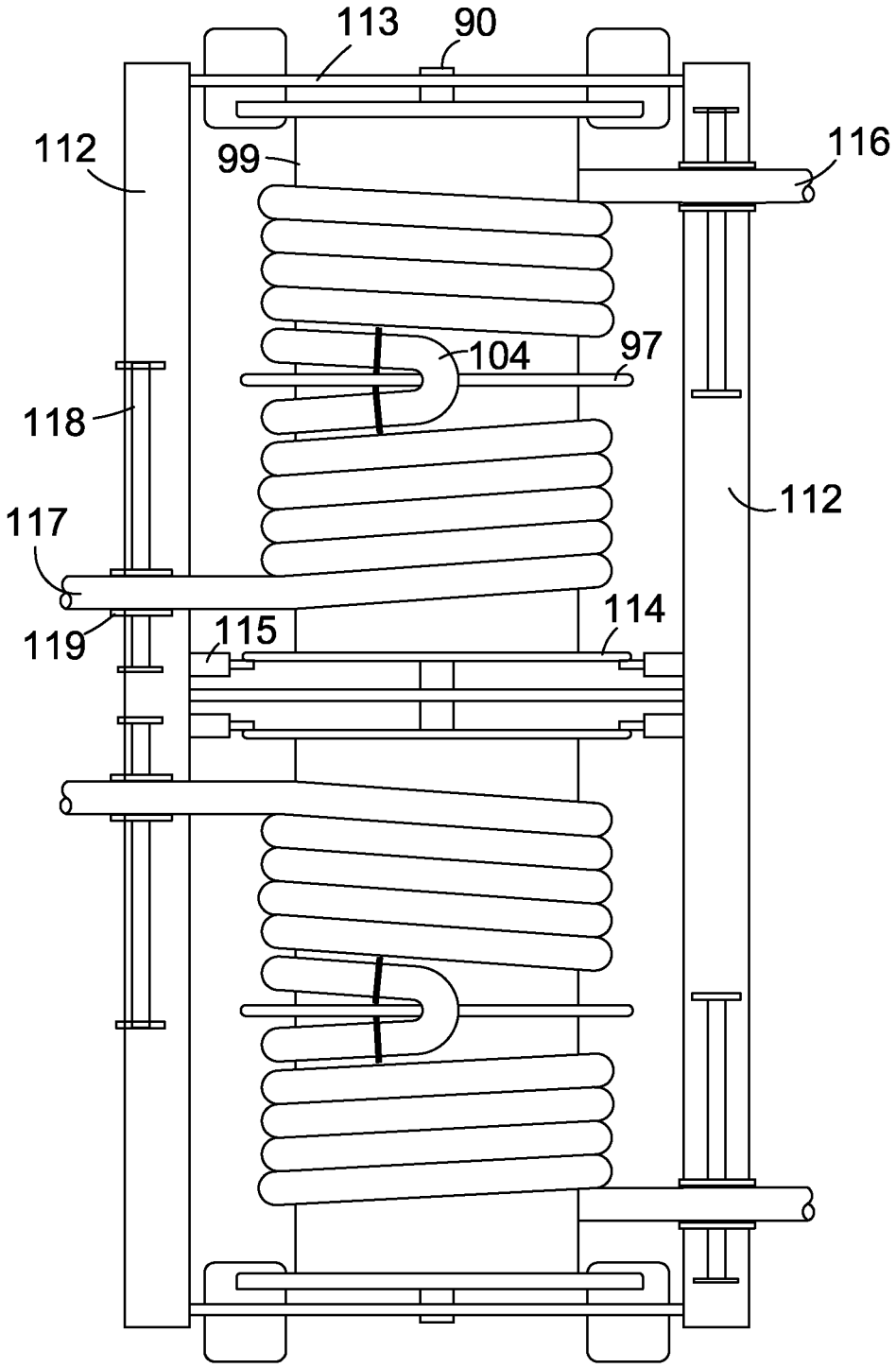

FIG. 2A and FIG. 2B are a second embodiment of this invention. A lying reel 110 is floating in water with a drum 99 and axle 90 parallel to water surface 93. The drum 99 is anchored to axle 90 through spokes 91. The axle 90 is freely rotatable around pipe shoes 111 located at the ends and in the middle. Pipe shoes 111 are anchored to buoys 112 with structural members 113. At one end of drum 99, there is a driving flange 114 that can be driven by motors 115. As motors 115 rotate, drum 99 rotates with the axle 90. A middle flange 97 separates the drum surface into two collecting areas. A coupler 104 goes through the middle flange 97 with one opening at each collecting area. Both openings face a clockwise winding direction. Please note the winding direction can be anticlockwise as well. Internal ends of LD (Low Departure) hose 116 and HD (High Departure) hose 117 are fluidly connected with the coupler 104. Both hoses are wound clockwise around the drum 99 in a spring-like fashion away from the middle flange 97.

Threaded shafts 118 are attached to the buoys 112 and used to control the feeding position of hoses through rollers 119. Specifically, travelling hoses cause rollers 119 to turn around their shafts, which generate translation movements along the threaded shafts fixed at both ends. The rollers 119 are preferred to have a rough surface in order to prevent slippage between the roller surface and hose. As such, hoses are wound evenly around the drum. Alternatively, gears and worm shafts can be used especially when multiple layers of hoses are wound. The horizontal movement of rollers 119 is controlled by the rotation angle of the reel in this case. The mechanism of worm shaft is not new, and no details about the worm shaft and gears are drawn here.

To provide two flow paths, a second reel is added. Two reels share axle 90 and form a symmetric mobile transfer system with two LD hoses near the ends and two HD hoses near the center. The buoys 112 are longer than the drum 99 so that the hoses are protected. The buoys provide buoyancy and prevent the drum from sinking and overturning (i.e., any rotation not along the axis of drums) under ocean waves. For offshore application, this reel assembly works well without wheels. It can be towed to harbor for safety or repair. On the other hand, when wheels 120 are used to support the reels, the mobile transfer system can be towed onto dry ground for storage or for repair purposes.

Figure 3B:
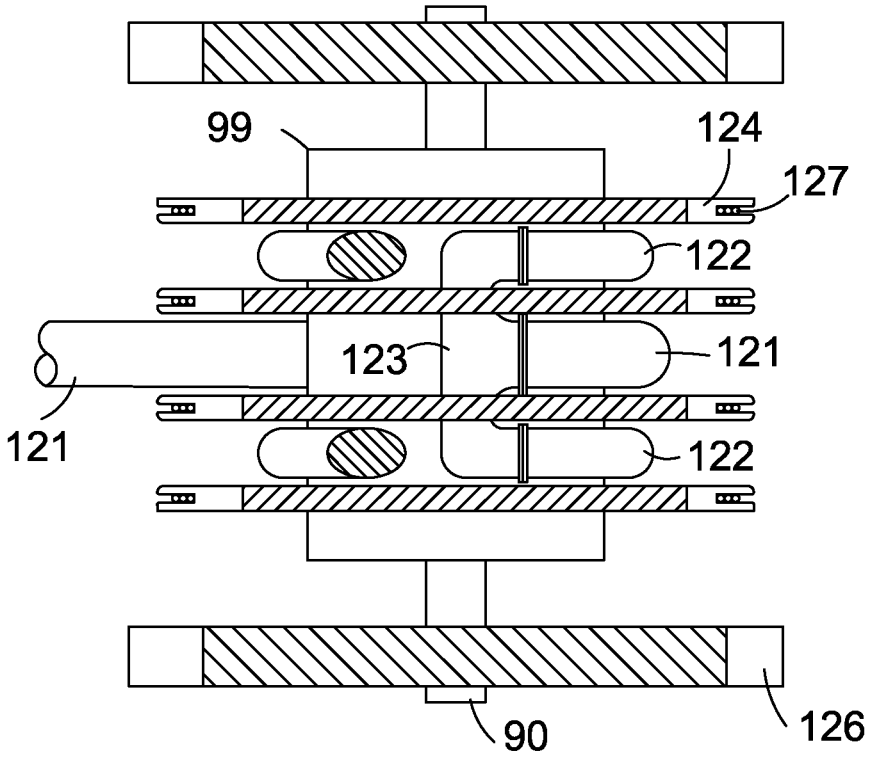

FIG. 3A and FIG. 3B show a third embodiment of this invention with a middle hose 121 (large in size) and two side hoses 122. Three hoses are connected with an E-shaped coupler 123 (with three branches) at a drum 99. The coupler 123 is located on drum 99, and is anchored either to drum 99 or flanges 124. Filler 125 is used around the coupler 123 and creates a smooth surface for hoses. Ropes 127 are wound around the groove of flanges 124 in order to collect hoses. Two big wheels 126 (larger than the flange size) are attached to the drum 99 through axle 90. These two wheels can provide mobility, buoyancy and protection for flanges and hoses. This embodiment has hoses wound over previously wound layers, and is ideal for collapsible hoses (hoses become flat after transfer operations).

Figure 4A:
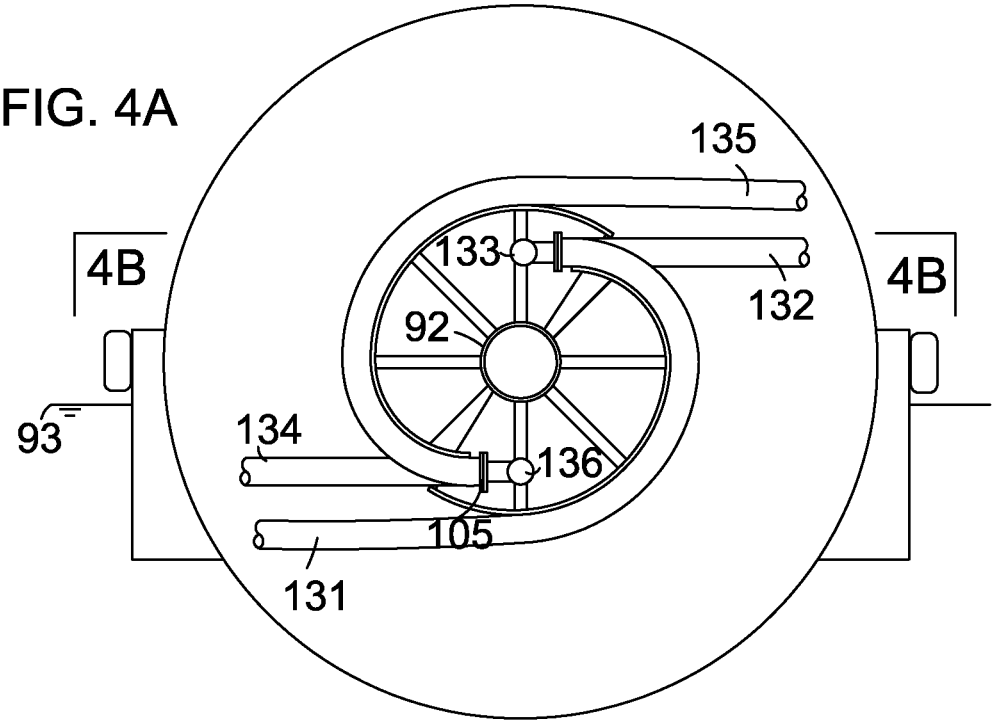
Figure 4B:
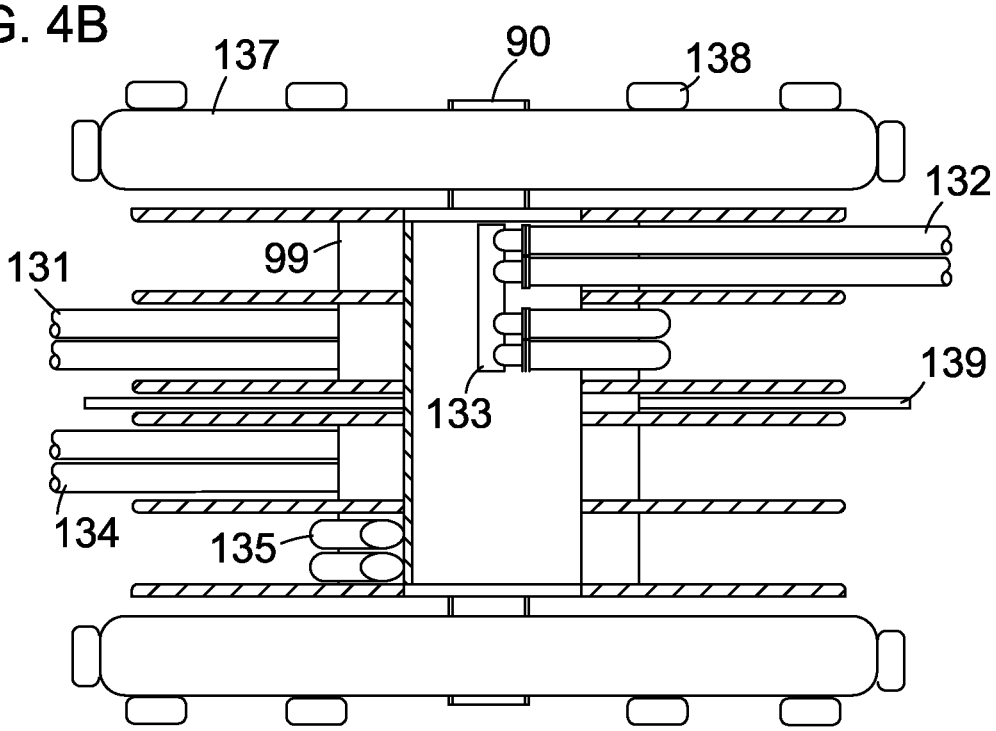
Figure 7A:
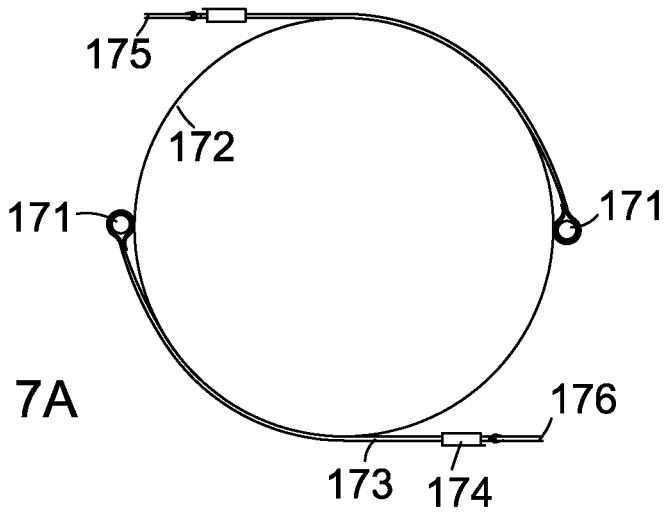
FIG. 7A is a detailed view of a pair of webbings wound around a reel.

FIG. 4A and FIG. 4B show a fourth embodiment of this invention with hose bundles. At each hose collecting area, two hoses are woven together and wound around a drum 99 over those layers wound previously. Two hoses are bonded together as a bundle with threads or the like (flexible material such as nylon) to prevent surface wearing caused by ocean waves. A first LD hose bundle 131 and HD hose bundle 132 are fluidly connected with a first hose header 133 (i.e., a coupler with four branches) at drum 99. Similarly, a second LD hose bundle 134 and HD hose bundle 135 are fluidly connected with a second hose header 136. Buoys 137 are attached to axle 90 through ball bearing rollers (not shown). Bumpers 138 are attached to buoys 137 for protection. In the middle of drum, there is a collecting area for webbing 139. Refer to FIG. 7A for details about webbing winding. In order to increase the buoyancy of hoses, light materials are wound around the hoses so that its external size is large than the end flanges of hoses. Alternatively, a coupler with two branches can be used for connecting a pair of hoses, in which four flow paths can be established and used for up to four types of fluids. Alternatively, three or more hoses can be bundled together and use a collecting area.

Figure 5A:
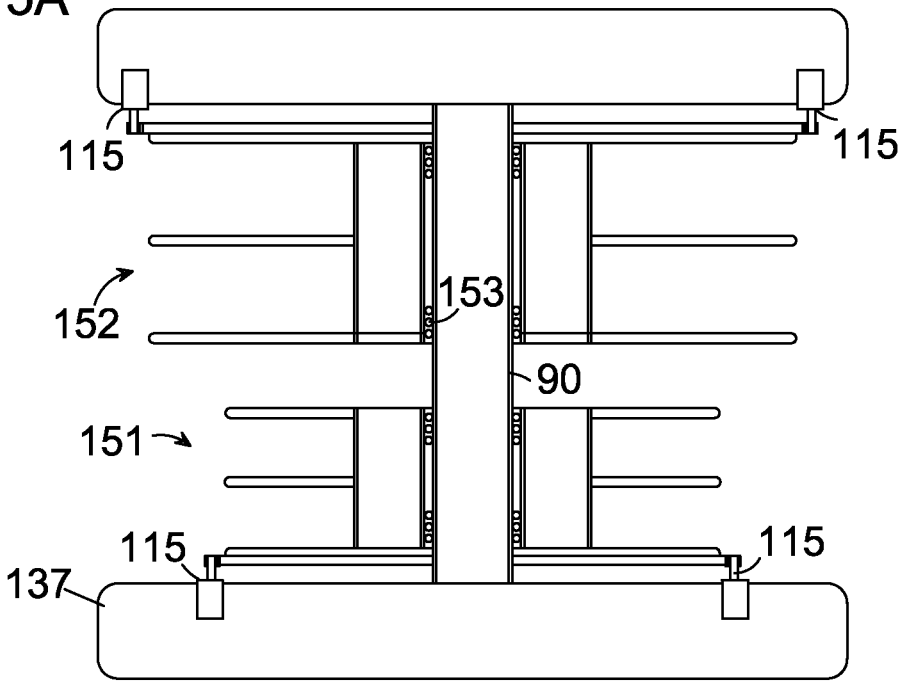
FIG. 5A is a tope view of two reels rotated independently by motors.

FIG. 5A is a variation to FIG. 4B with motor arrangements. Two buoys 137 are fixed to an axle 90 at the ends of the axle. Small reel 151 and large reel 152 are able to rotate independently around axle 90 with ball-bearing rollers 153. A first pair of motors 115 is anchored to one nearby buoy and drives small reel 151. Specifically, the motors can be set with a small resistance when hoses are pulled out. To collect hoses, the motors generate a torque higher than the resistance from hoses to turn the reel 151 opposite to the winding direction of hoses. Similarly, a second pair of motors 115 is anchored to the other buoy and drives large reel 152.

Figure 5B:
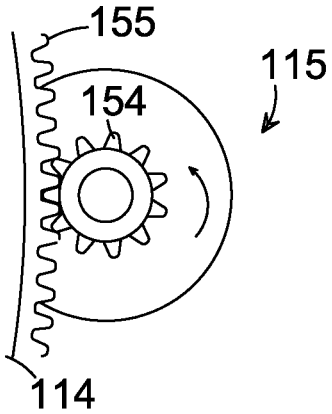
FIG. 5B is a detailed view of a motor driving the outer edge of a flange.

FIG. 5B shows a driving detail of a motor 115. A motor shaft 154 drives gears 155 on the circumference of a driving flange 114. As motor shaft 154 turns counterclockwise, driving flange 114 turns clockwise.

Figure 5C:
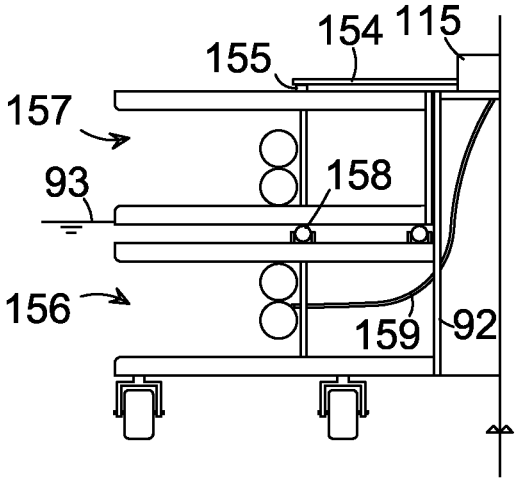
FIG. 5C is an elevation view of two reels driven by a motor.

FIG. 5C shows an alternative motor arrangement for two reels standing as the one shown in FIG. 1B. To save the paper space, only a half of the embodiment is shown (the other half can be mirrored through the axis of the reel). In this case, the hub 92 of a bottom reel 156 is extruded upwards and serves as an axle for a top reel 157 (i.e., coaxially). Roller rings (consisting of a number of ball rollers arranged in a circle) 158 allow the top reel 157 to rotate freely on the top of bottom reel 156. A motor 115 is anchored to the top of hub 92 with motor shaft 154 engaged with gears 155 on a top flange of top reel 157. A cable 159 extends from the base of motor 115 to one hose wound at bottom reel 156 where the cable and hose are bundled together. Cable 159 provides electricity and control. With two hoses (i.e., one top hose and one bottom hose) wound on top reel 157 opposite to two hoses wound on bottom reel 156, all hoses are pulled out or wound up simultaneously. Alternatively, the motors can be driven or powered by pressurized fluids through an umbilical. The commonly used fluids in the prior art include air and water. Alternatively, a pair of ropes can replace two hoses in top reel 157 and serves as a driving means. Locking pins (not shown) can be inserted between the top reel 157 and the hub 92 or between two reels at flange or drum locations so that two reels can rotate together for collecting hoses.

Figure 6A:
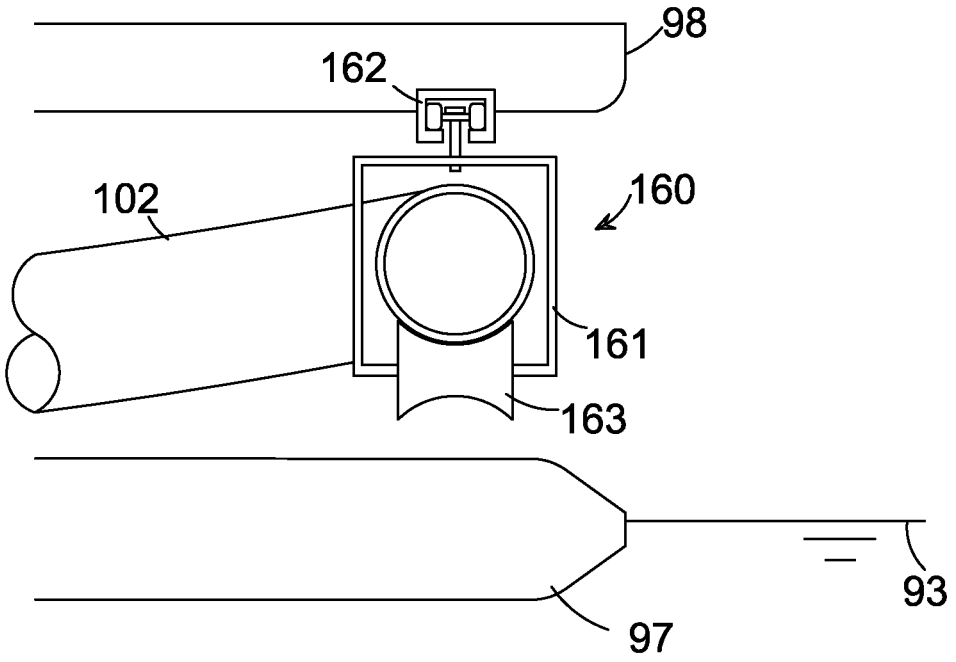
FIG. 6A is a detailed view of a cart lifting a hose off its support.

FIG. 6A shows a cart used in conjunction with a mobile reel shown in FIG. 1B. A box beam 162 is embedded at a top flange 98 near the outer edge. The box beam 162 has a round track inside and a downward opening. A cart 160 is hung underneath top flange 98 through the downward opening. The cart 160 has a hose hanger 161 and a roller 163 at the bottom. A top hose 102 is supported on the roller 163 and lifted off the top surface of the middle flange 97. As top hose 102 is winding or unwinding, the cart 160 travels along the round track automatically. This cart reduces friction and wearing between the top hose 102 and middle flange 97 (i.e., supporting flange) for the segment around the cart (i.e. partially). Alternatively, a round track can be attached to the middle flange 97 near the outer edge. A cart with small wheels at the bottom is adapted to travel along the round track and lift hose off its supporting flange with a roller 163 at the top of the cart.

Figure 6B:
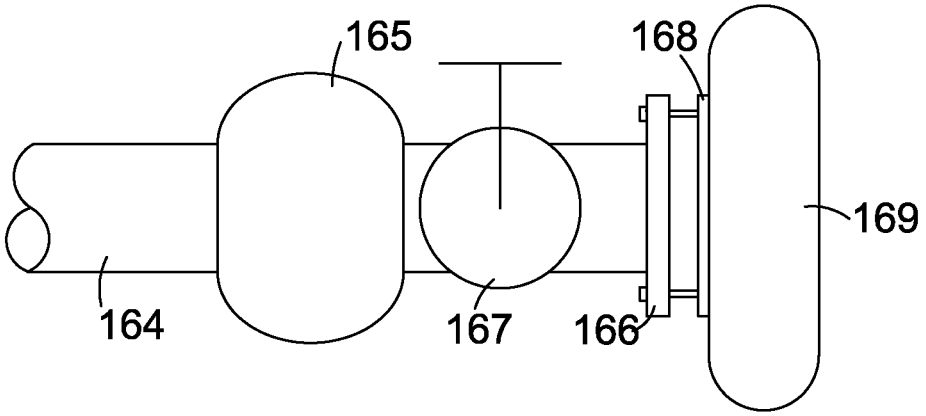
FIG. 6B is a detailed view of end fittings at an external end of hoses.

FIG. 6B shows an external end of a HD hose 164. Right next to an end flange 166 (an example of end fittings), there is a valve 167, and a collar 165 for buoyancy and protection. The valve 167 preferably serves as a part of ERC (Emergency Release Coupler) or a break-away coupling. A blind flange 168 is bolted to the end flange 166 after a transfer operation (not fully bolted in the picture for clarification). A second collar 169 is tied to the blind flange 168 through stripes (not shown) to provide additional buoyance and protection. When the external end of HD hose 164 is pulled back to a reel, it can be tied to a reel flange (e.g., middle flange 97) with a stripe for the case shown in FIG. 1B or supported on a seat anchored to a buoy 112 for the case shown in FIG. 2B. Alternatively, a Quick Connection and Dis-Connection device (QCDC) can be fluidly connected to an end flange 166.

Figure 7B:
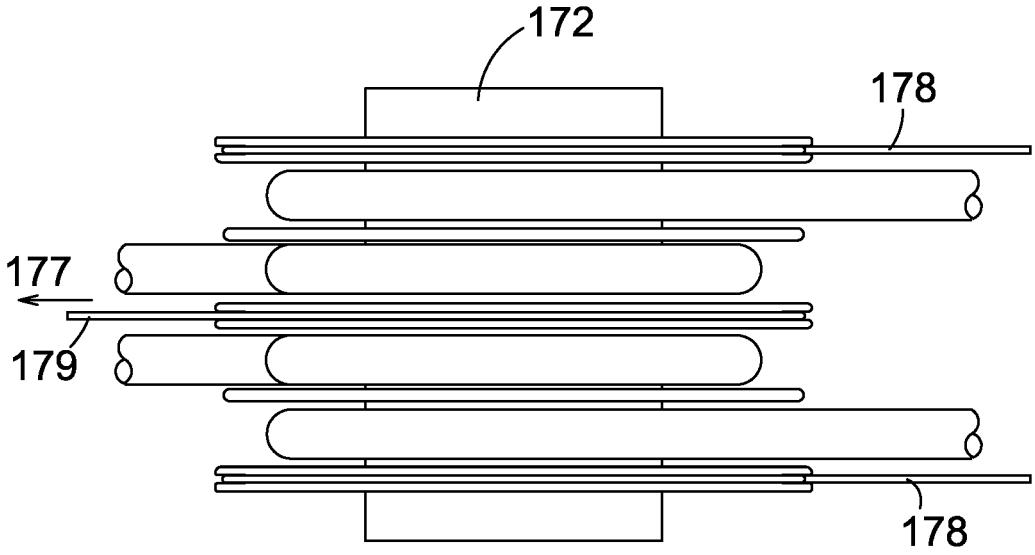
FIG. 7B is a variation of FIG. 7A with three ropes wound around a reel.

FIG. 7A and FIG. 7B show a rope arrangement to turn a reel. As shown in FIG. 7A, two anchoring pins 171 are anchored near the outer surface of a drum 172. Two short ropes 173 are tied to anchoring pins 171 with buckles 174 at free ends. The buckles are used for quick connection and disconnection with long ropes (at least twice the separation distance between a ship and a second location). HD rope 175 is hooked up with buckle 174 at the top while LD rope 176 is hooked up with buckle 174 at the bottom. When the drum 172 rotates clockwise, both ropes (175 and 176) are wound around drum 172. On the contrary, pulling ropes (175 and 176) by outer ends forces drum 172 to rotate counterclockwise. HD rope 175 and LD rope 176 can share a collecting area. They can be wound in a separated collecting area right next to each other as well. When webbings are used, it is preferably that two ropes share a collecting area with one overlaid the other. Alternatively, three ropes can be used as shown in FIG. 7B. Two side ropes 178 and one middle rope 179 are wound in three rope collecting areas, respectively. Hold two side ropes 178, and pull middle rope 179 in a direction 177, a drum 172 is forced to rotate counterclockwise. The ropes are arranged with pulling forces being balanced out.

Figure 8A:
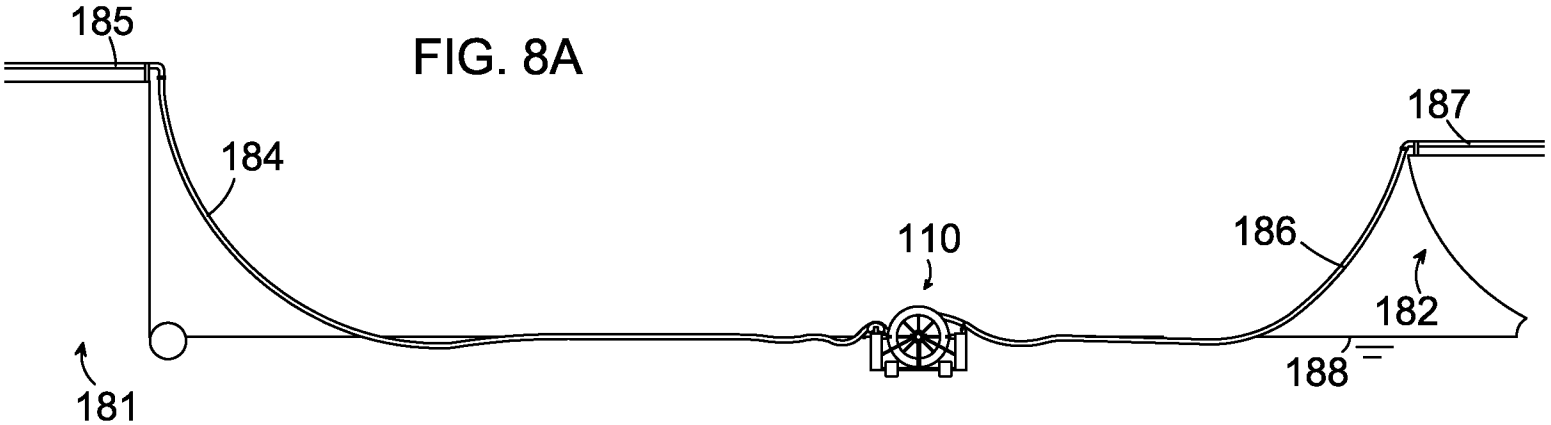
FIG. 8A and FIG. 8B are a first application of the transfer system between a ship and a stationary vessel in a tandem configuration
Figure 8B:
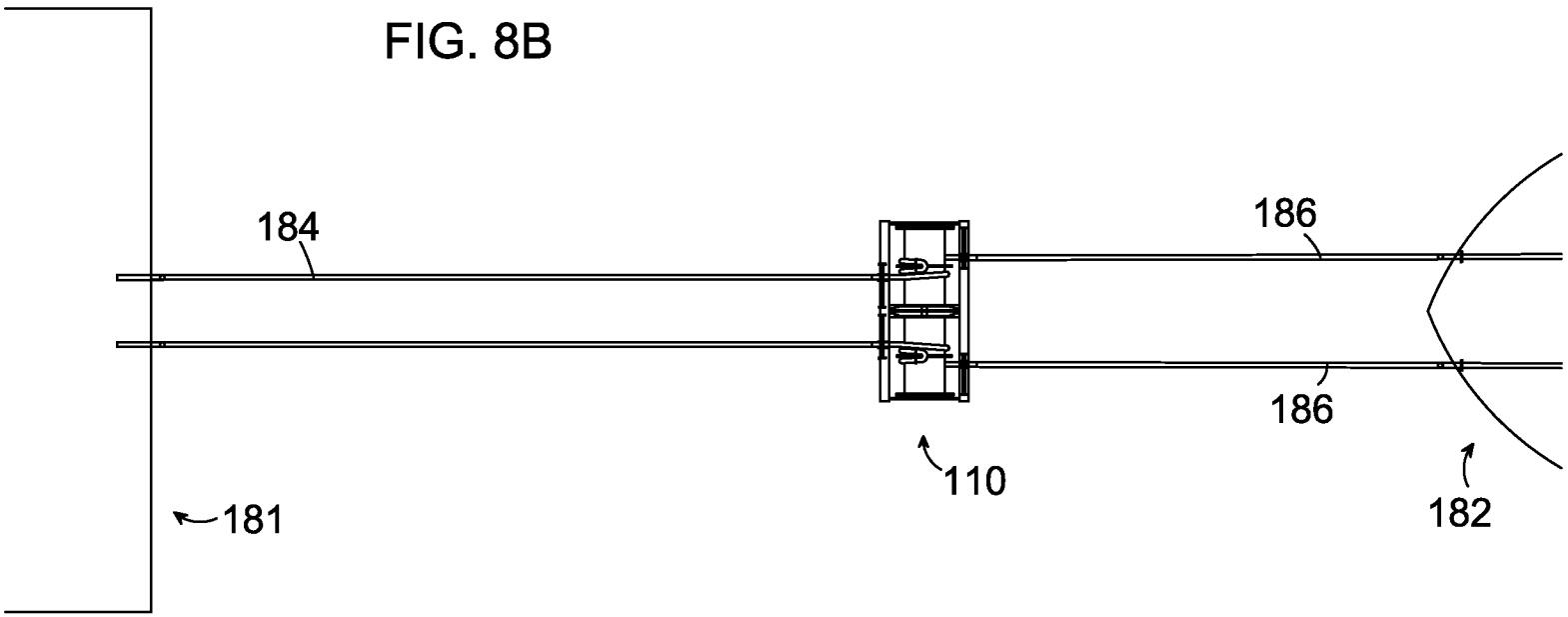

FIG. 8A and FIG. 8B show a first application of this mobile transfer system in a transfer position between two vessels. A stationary vessel 181 and a tanker 182 are docked offshore in a tandem configuration. A lying reel 110 is located in the middle with two flow paths, each formed with a first hose 186 extending to bow manifolds 187 on a tanker 182 and a second hose 184 extending to stern manifolds 185 on stationary vessel 181. Definition of "first" in first hose and first rope is the one connected to a ship, and "second" is the one connected to a second location. A first hose can be either a bottom hose or top hose shown in FIG. 1B, as well as a HD hose or a LD hose in FIG. 2A. A first hose or second hose can be a single hose, a hose with external insulation/buoyancy layers, a hose in hose or a hose bundle. Other equipment including cranes, manifold extensions, alignment assistant tools and control devices may be used to assist the connection/disconnection. Those tools are widely used (for example in U.S. Pat. No. 6,886,611) and not shown here.

A mobile transfer system is typically docked at a stationary facility with an external end of a second hose fluidly connected to the facility. Fluid communication between a stationary facility and ship is established by pulling the external end of a first hose toward a ship. Motors 115 as shown in FIG. 5A can be set at a pre-determined torque level on the reel 110 opposite to the winding direction of hoses and adapted to adjust the paid-out length of hoses in order to keep hoses in certain tension during the pulling process and during fluid transfer. For example, more hose will be paid out when the pulling force in the hoses overcomes the torque. When fluid transfer is over, close valves at the external end of first hose 186 and disconnect end flanges. As the lying reel 110 is turned counterclockwise by motors, second hose 184 and first hose 186 are wound simultaneously. The external end of first hose 186 travels at twice the speed of the internal end. A rope used to pull the external ends of first hose 186 over to tanker 182 can be used to lower the external ends down and provide some tension during winding of hoses. An umbilical is connected to stationary vessel 181 and extends to the lying reel. This umbilical is preferably bundled with one of the hoses as shown in FIG. 5C. Alternatively, the umbilical can float separately. When floating alone, an umbilical reel on the stationary vessel is winding as the reel is dragged back toward the stationary vessel.

Figure 9A:
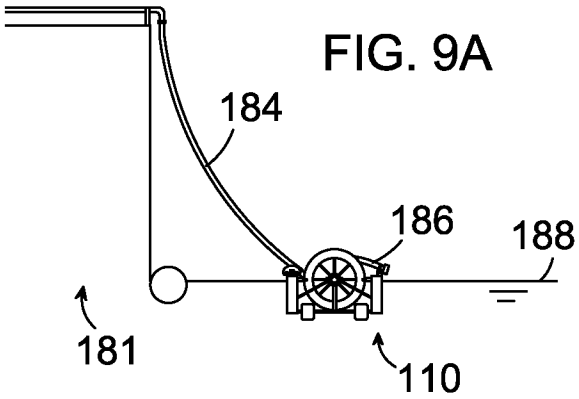
FIG. 9A is an elevation view of a mobile transfer system at a docked position.

FIG. 9A shows a mobile transfer system at a storage position. First hose 186 and second hose 184 are wound up around the lying reel 110 and the system is docked behind the stationary vessel 181. The motors 115 as shown in FIG. 5A are at a locked position when the power is off. This prevents reel from being wandered away. In normal weather conditions, stationary vessel 181 protects reel and hoses from waves/winds. To prevent end valves and flanges at external ends from bumping into each other, a protective collar can be wrapped around (as shown in FIG. 6B). The second hoses can be disconnected from the stationary vessel and the mobile transfer system can be towed to a second site for a subsequent fluid transfer, or towed to a harbor for safety when extreme weather approaches.

Figure 9B:
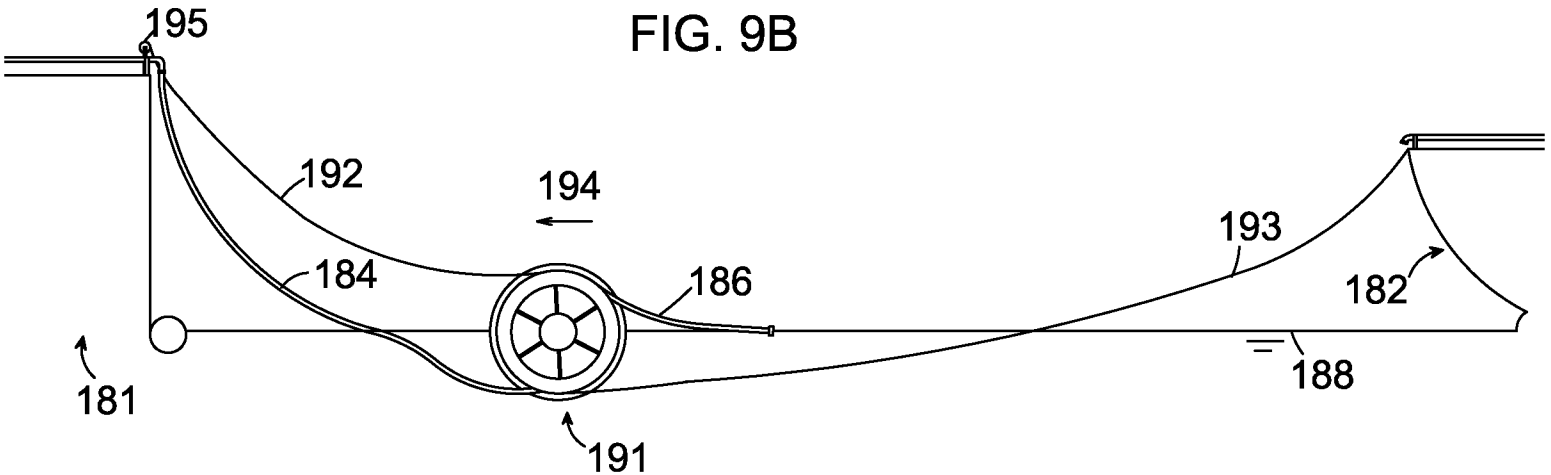
FIG. 9B is an elevation view of a mobile reel with ropes being used to collect hoses.

FIG. 9B shows a lying reel 191 being turned with ropes. A second rope 192 extends from a stationary vessel 181 to the reel 191. A first rope 193 extends from the reel 191 to a tanker 182. Once fluid transfer is over and the external end of first hose 186 is disconnected from the bow manifolds on tanker 182, pull second rope 192 from stationary vessel 181 using a winch 195 while first rope 193 is still tied to tanker 182. This causes reel 191 to turn counter-clockwise and collect all hoses simultaneously with reel 191 being dragged towards the stationary vessel 181 along a moving direction 194. Once first hose 186 are fully wound, additional short ropes can be used to tie the external end of first hose 186 to one of reel flanges for storage. The second rope 192 and remaining part of second hose 184 can work together and moor the reel 191 behind the stationary vessel 181. After the first rope 193 is disconnected from tanker 182, the tanker 182 is ready to sail away.

A method for fluid transfer using the system disclosed above includes several steps. The first step is placing the system between a ship and a second location. For the case shown in FIG. 9A, reel 110 is docked behind a stationary vessel 181. When tanker 182 arrives, tie a pulling rope (not shown) to the external end of first hose 186 and tie a first rope 193 to a designed rope collecting area (e.g., insert its end to an anchored buckle as shown in FIG. 7A) of the reel. Extend the pulling rope and first rope 193 to the tanker 182 and tie the other end of first rope 193 to the tanker 182. Pull the pulling rope towards the tanker while release second rope 192 accordingly from the stationary vessel 181. As the hoses are being pulled out, the reel 191 rotates clockwise and moves towards the tanker 182, and two ropes (first rope 193 and second rope 192) are wound around reel 191 partially. Next step would be tying-in the external end of the first hoses to the ship manifolds onboard tanker 182, and establishing flow paths as shown in FIG. 8A. The last step is transferring fluid through the flow paths. With a torque applied at the reel opposite to the winding direction of hoses (controlled by a holding force in the second rope 192), both hoses are in tension during fluid transfer.

Figure 10:
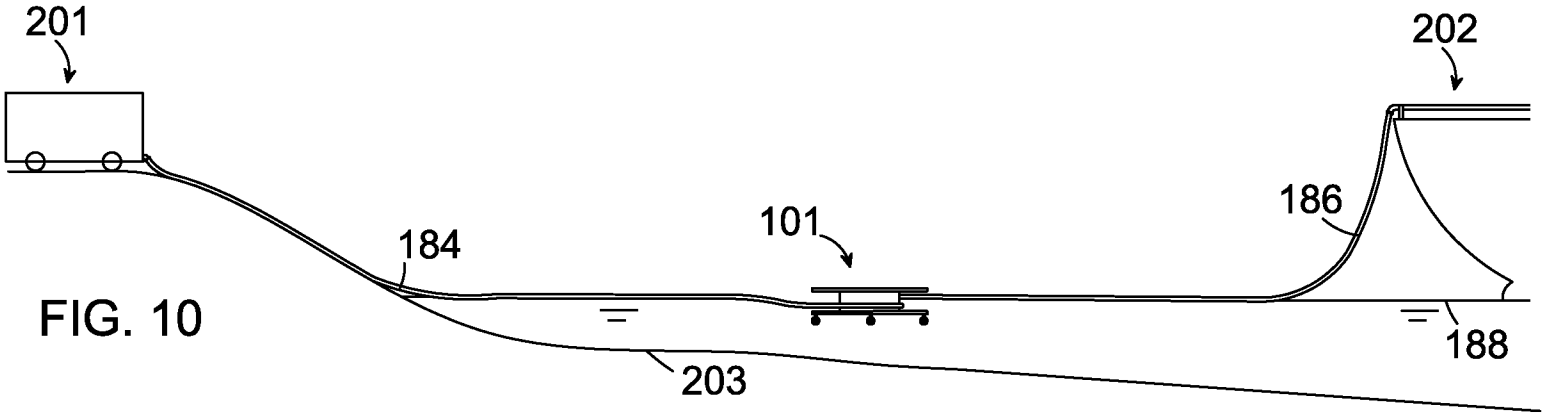
FIG. 10 is a second application of this invention between a fuel truck and a ship.

FIG. 10 shows a second application of the transfer system in a transfer operation between an onshore location and a tanker. A standing reel 101 floats on a water surface 188 with a seabed (or river bed, or lake bed) 203 below. A second hose 184 extends from a fluid delivery truck 201 to the standing reel 101 while a first hose 186 extends from the standing reel 101 to a ship 202. Ropes are not shown for simplicity. Alternatively, the onshore location can include storage tanks, and pipe manifolds fluidly connected to storage tanks.

Figure 11:
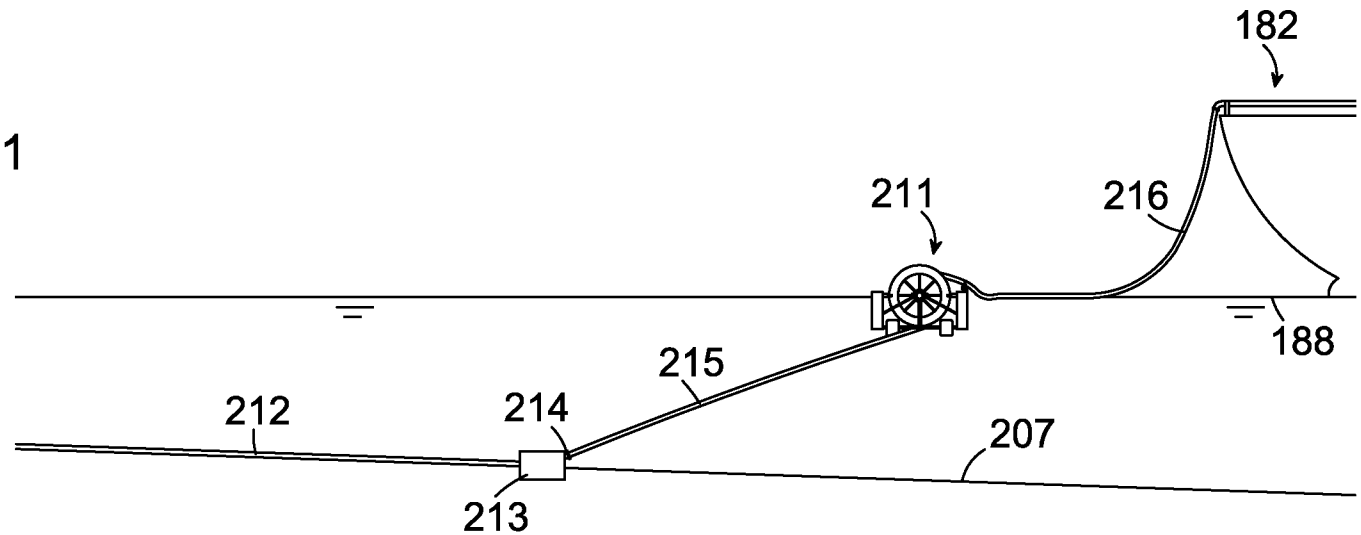
FIG. 11 is a third application of this invention between a subsea pipeline and a ship.

FIG. 11 shows a third application of the transfer system in a transfer operation between a subsea location (e.g., Pipe-Line End Manifolds, or PLEM) and a tanker. A subsea pipeline 212 is laid on a seabed 207 and ends at a supporting structure 213 with at least one valve (not shown) and manifolds 214. A lying reel 211 floats at a water surface 188. First hoses 216 extend from a tanker 182 to the lying reel 211 while second hoses 215 extend from the lying reel 211 to the subsea manifolds 214. In this case, it is optional that first hoses 216 are fluidly connected with tanker 182 first. With pulling and alignment tools tied to the supporting structure (not shown), the external ends of second hoses 215 are pulling towards the manifolds 214 and fluidly connected with manifolds 214. Alternatively, the manifolds 214 have upwards openings, and lying reel 211 is moored above the manifolds and located below water surface 188 under a high tension from second hoses 215. Alternatively, the end of pipeline 212 can have only one opening, named PLET (Pipe-Line End Tie-in). Alternatively, the subsea pipeline can be buried, or elevated above the water surface in shallow water. Alternatively, this subsea location is at a shipping channel, and a second hose 215 is fluidly connected to a suction header for dredging operations. Alternatively, this subsea location is at a water surface, and a second hose 215 is fluidly connected to a suction header for cleaning operations (e.g., spilled oil on the water surface).

Figure 12A:
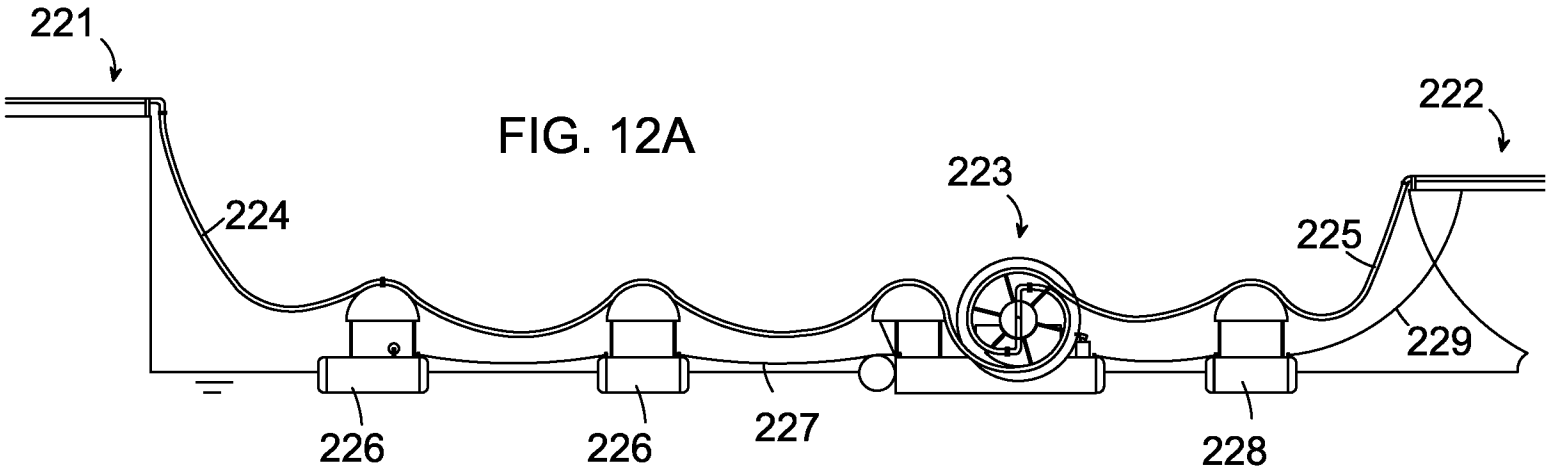
Figure 12B:
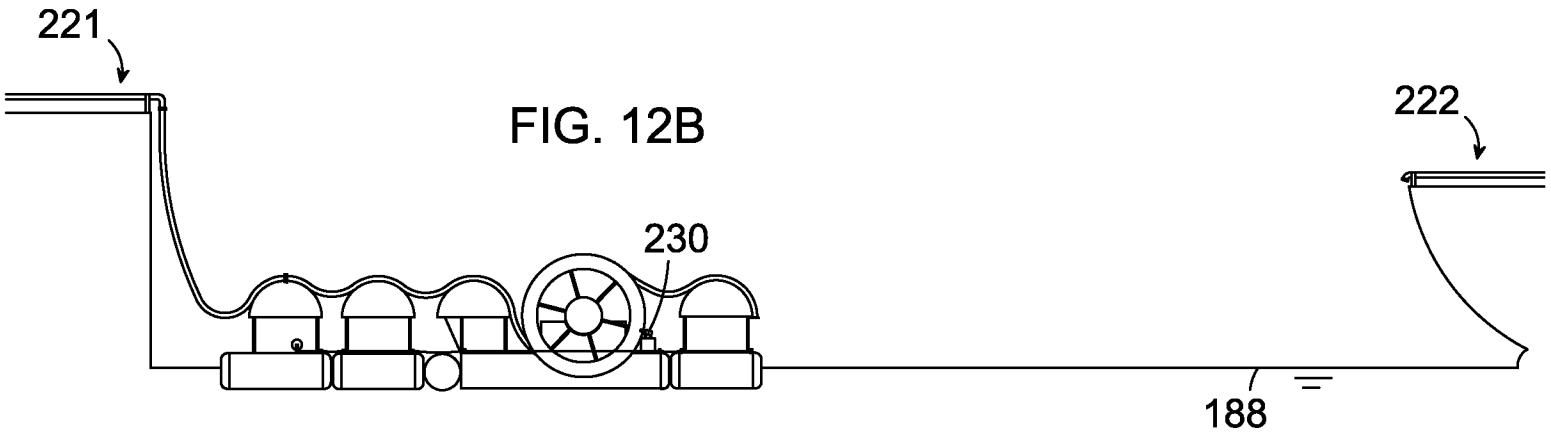
FIG. 12B is an elevation view of the system in a docked position.

For cryogenic fluids such as LNG (Liquefied Natural Gas), the floating hoses for cryogenic fluids are preferred if available. Alternatively, cryogenic hoses can be supported above water. FIG. 12A shows a scheme for loading cryogenic fluids. A LNG tanker 222 is docked behind a FLNG vessel 221. A first hose 225 is in fluid communication with tanker 222 while a second hose 224 is in fluid communication with FLNG vessel 221. In addition to a reel buoy that supports a lying reel 223, there are several other buoys (e.g., a front buoy 228, rear buoys 226). Each buoy has a saddle on top to hold hoses in air. Each saddle on the buoys has a convex surface formed with roller bars and side guides, and has a radius larger than the minimum bending radius of hoses. A saddle support can increase the contact area with hose and change hose direction when needed. The max distance between two buoys is determined by the length of a rope 227 for example, and the distance between front buoy 228 and tanker 222 is determined by a front rope 229. Once fluid transfer is over, turn motor 230 to wind up hoses and store buoys behind FLNG 221 as shown in FIG. 12B. Alternatively, air-inflated floaters can be used. It is preferably that compressed floaters are evenly attached to the hoses and are inflated with air after hose connection is established.

Figure 13:
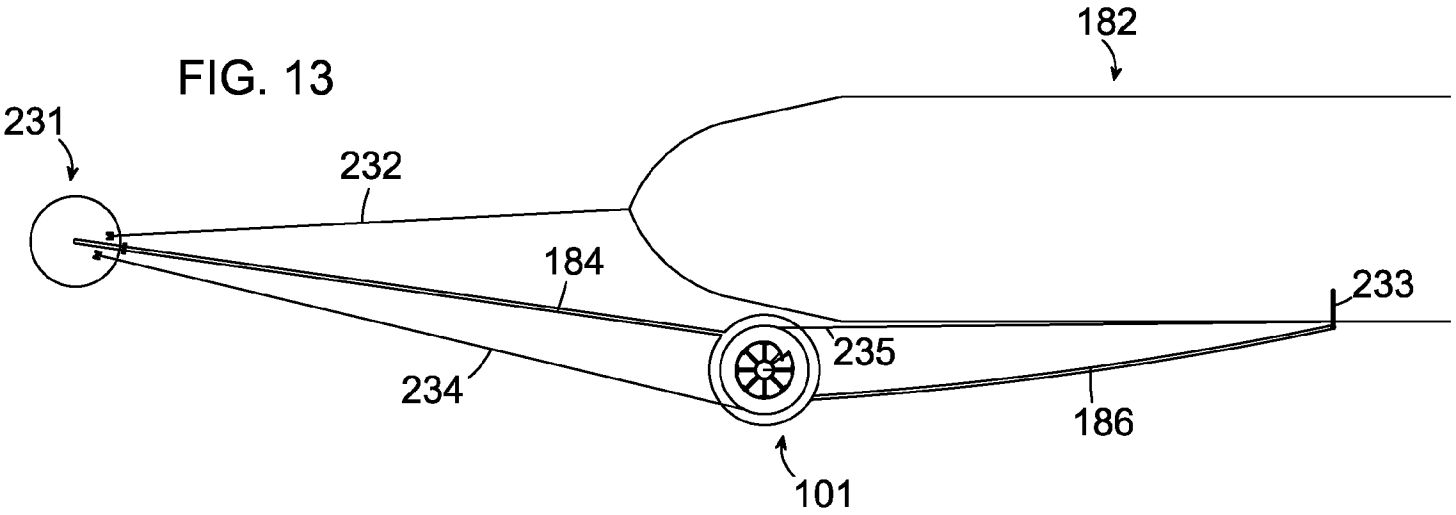
FIG. 13 is a fourth application of the system in a transfer operation between a SPM turntable and a ship (top view)

FIG. 13 shows a fourth application of the transfer system in a transfer operation between a turntable 231 on a SPM buoy and a tanker 182 with a hawser 232 for mooring tanker 182. A loading buoy is anchored to a seabed through chains and has a base structure for turntable to sit and turn. A turntable is fluidly connected to storage tanks or floating production vessels. It is a common practice in oil industry and no details are given. A standing reel 101 leans on a side of tanker 182. A second hose 184 extends from the turntable 231 to standing reel 101 while a first hose 186 extends from the standing reel 101 to mid-ship manifold extension 233 on tanker 182. Please note a typical mid-ship manifold ends with a presentation flange that is about 3.5 m away from the nearby ship edge. This manifold extension 233 is fluidly connected with the ship manifold at the presentation flange and extends beyond the ship edge with a bend and a preferred downward opening. Details can be found in prior art for example in U.S. Pat. No. 6,886,611. Similarly, a second rope 234 extends from turntable 231 to standing reel 101 while a first rope 235 extends from standing reel 101 to tanker 182. By adjusting the tension on the ropes, both hoses can be in a certain tension with a straight line or nearly straight line from a top view. Alternatively, a turntable can be elevated above water on a reinforced concrete shaft that is anchored to the seabed below. Alternatively, a SPM buoy can be located below a water surface.

Figure 14:
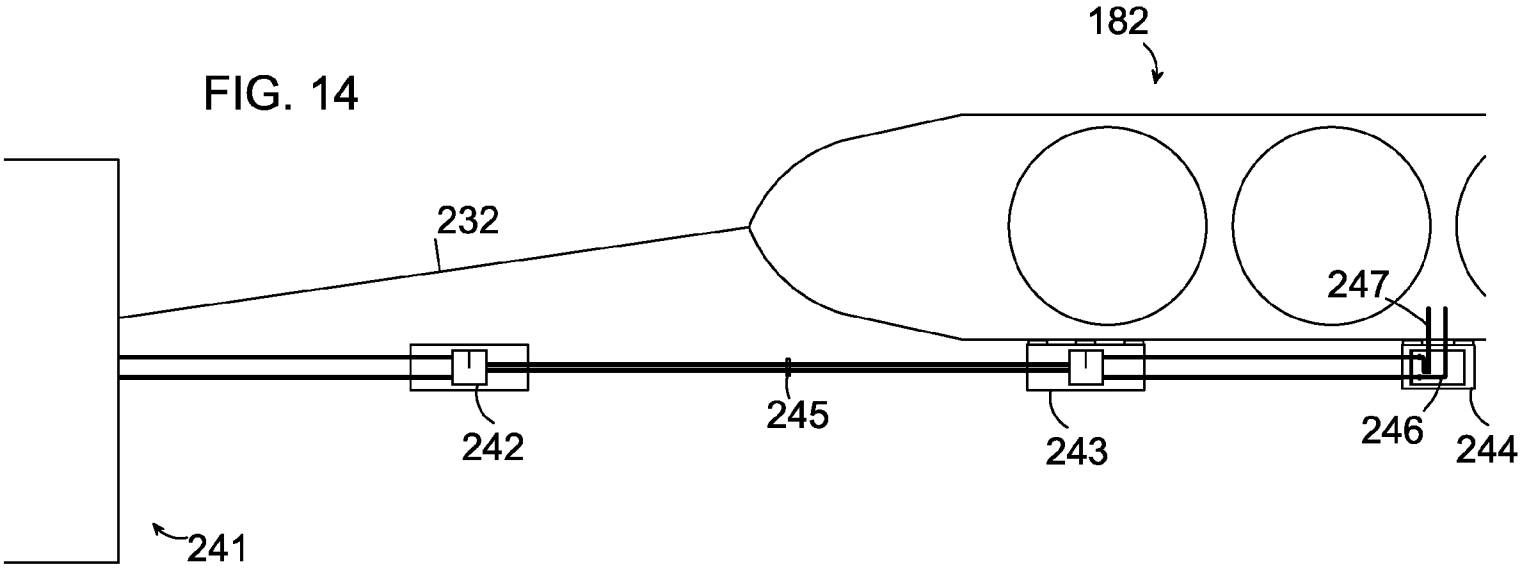
FIG. 14 is two mobile transfer systems working in series (top view)

When a transfer system is not long enough to cover the separation distance between a ship and a second location, two or more mobile reels may be needed. FIG. 14 shows two mobile reels of the invention arranged in series to reach mid-ship manifolds. A tanker 182 is docked behind a stationary vessel 241 with a hawser 232 in a tandem configuration. A primary reel 242 with one set of hoses is generally long enough for stern-to-bow transfer. However, for many existing tankers, manifolds are located at the middle of ship. A second reel 243 is arranged in series with primary reel 242. Through flange connection 245 in the middle, hundreds meters of flow paths can be established. For cryogenic fluids, a front buoy 244 is used to keep end fittings 246 above water during pulling and to host additional flexible tubes 247 for fluid connection with mid-ship manifolds that are several meters short from the ship edge. The front buoy 244 can be equipped with thrusters (not shown) and sail to mid-ship manifolds of a tanker 182. Alternatively, the front buoy is a tugboat that sails toward the mid-ship manifolds and pulls hoses out of reels.

Figure 15:
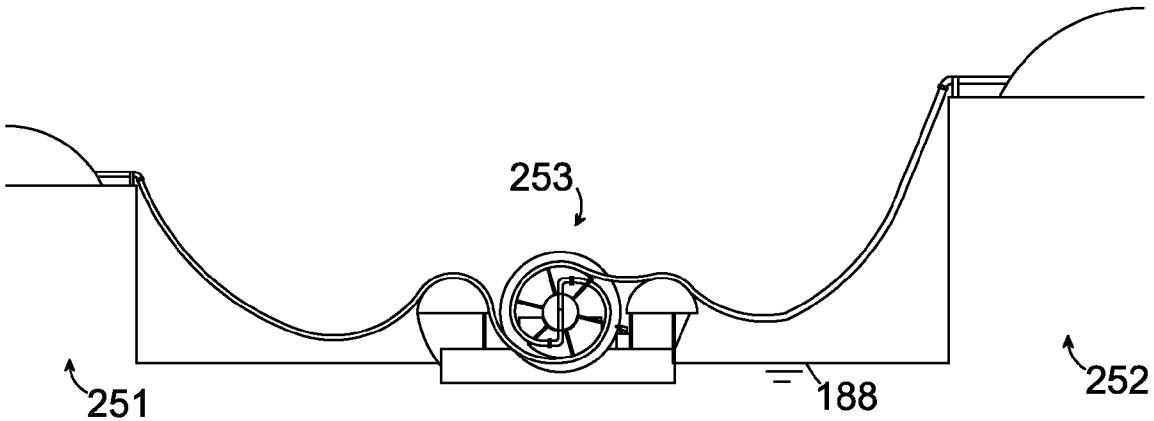
FIG. 15 is a fifth application of this invention in a lightering operation using mid-ship manifolds (elevation view)

The mobile transfer system is ideal for transfer operations in a harsh environment. However, the system can also be used for fluid transfer in calm water. In this case, one can use a reel with short hoses, or use a reel with long hoses in small paid-out length. FIG. 15 shows a fifth application of the transfer system in a lightering operation using mid-ship manifolds. A small tanker 251 and a large tanker 252 are docked side by side at a safe distance away (e.g., 40 m). A transfer vessel 253 has the transfer system elevated above water on a vessel with thrusters for sailing (thrusters not shown) and is located in the middle of two tankers for fluid transfer. Alternatively, the transfer system of this invention can sit on top of a fixed loading platform. Alternatively, the safe distance between two tankers can be as small as the width of a lying reel shown in FIG. 2B where the laying reel serves as a fender. Alternatively, a FPSO, a FLNG or a drilling vessel can be in the place of the large tanker 252 while a service vessel or a fuel barge can be in the place of the small tanker 251.

Figure 16:
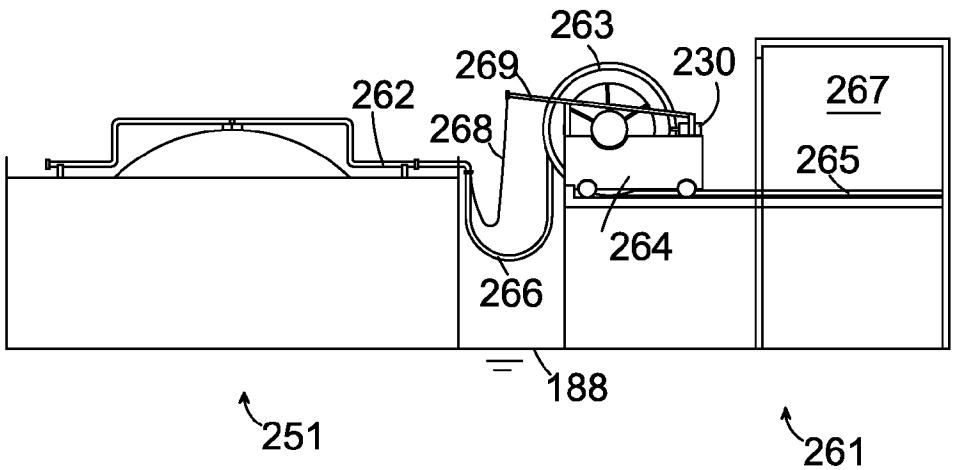
FIG. 16 is a sixth application of this invention in a side-by-side transfer between a tanker and a loading platform (elevation view).

FIG. 16 shows a sixth application of the invention in a side-by-side transfer between a tanker and a loading platform. A tanker 251 is docked at a loading platform 261. On the platform 261, a reel 263 sits on a dolly 264. A first hose 266 is fluidly connected with mid-ship manifold 262 on tanker 251 while a second hose 265 is fluidly connected to piping (not shown) on the platform. A cantilever beam 269 is extended out and used to break a free-fall of first hose 266 along with a rope 268 tied to the external end in case of emergency. Once transfer is over, a motor 230 can turn the reel 263 so that the hoses are collected and the reel 263 travels back to a storage room 267 for protection. To reduce the length of the second hose 265, a small drum size can be used for the designated collecting area of reel 263 for the second hose 265.

I claim:

1. A transfer system for fluid communication between a ship and a second location separated by a body of water, said transfer system comprising:

a) a reel having a drum;

b) a coupler fixed at said drum, said coupler having a first opening and a second opening, both openings facing a winding direction around said drum;

c) a first hose having a first internal end and a first external end, said first internal end fluidly connected to said coupler at said first opening, and said first external end in fluid communication with said ship;

d) a second hose having a second internal end and a second external end, said second internal end fluidly connected to said coupler at said second opening, and said second external end in fluid communication with said second location;

e) a driving means for applying a torque on said reel opposite to said winding direction, wherein said first hose and said second hose are in tension during fluid transfer.

2. The transfer system of claim 1, wherein said driving means includes at least one motor along with an umbilical for providing power and control.

3. The transfer system of claim 1, wherein said driving means includes pulling a pair of ropes by outer ends from opposite directions, said ropes wound around said reel opposite to said winding direction with inner ends tied to said reel.

4. The transfer system of claim 1, wherein said driving means turns said reel opposite to said winding direction and collects hoses simultaneously after fluid transfer.

5. The transfer system of claim 1 further comprising a partition flange separating a first collecting area for said first hose from a second collecting area for said second hose.

6. The transfer system of claim 5, wherein said reel further comprising additional collecting areas separated from said first and second collecting areas.

7. The transfer system of claim 1 further comprising a plurality of buoyancy devices for keeping said reel afloat in water, said buoyancy devices are selected from the group consisting of closed cell foams, air-filled containers, or mixtures thereof.

8. The transfer system of claim 1, wherein said reel is supported on a platform above water.

9. The transfer system of claim 1 further comprising a plurality of wheels for supporting said reel and providing mobility on land.

10. The transfer system of claim 1 further comprising a saddle for supporting one of said first and second hoses, said saddle having a convex surface.

11. The transfer system of claim 1 further comprising end fittings at said external end of said first hose and said second hose.

12. The transfer system of claim 1, wherein said coupler has more than two branches for fluid connection with more than two hoses at said reel.

13. The transfer system of claim 1 further comprising another reel, wherein said a reel and said another reel are arranged in parallel for providing multiple flow paths between said ship and said second location.

14. The transfer system of claim 13 further comprising a locking pin for locking said a reel and said another reel together coaxially.

15. The transfer system of claim 13, wherein said a reel and said another reel share an axle and are driven by a motor for hose collection, and said motor is anchored to said a reel with a motor shaft engaged with said another reel.

16. The transfer system of claim 1 further comprising another reel along with additional hoses, wherein said a reel and said another reel are arranged in series between said ship and said second location.

17. The transfer system of claim 1, wherein said second location is underwater.

18. The transfer system of claim 1, wherein said second location includes a facility.

19. The transfer system of claim 18, wherein said facility is selected from the group consisting of a production vessel, a drilling vessel, a second sea-going ship, a fuel barge, SPM buoy, a turntable, a gravity-based storage tank offshore, a suction header offshore, a loading platform, a pipeline end manifold, a fluid delivery truck onshore and a storage tank onshore.

20. The transfer system of claim 1, wherein said first hose and second hoses are selected from the group consisting of a single plastic hose, a single composite hose made of plastic layers and metal rings, a single metal bellow hose, a hose-in-hose and a hose bundle.

21. The transfer system of claim 1, wherein said first hose and second hose are floating hoses.

22. The transfer system of claim 1, wherein said first hose and said second hose are insulated for transferring cryogenic fluids.

23. The transfer system of claim 1, wherein said reel is lying in water with an axis essentially parallel to a water surface.

24. The transfer system of claim 1 wherein said reel is standing in water with an axis essentially perpendicular to a water surface.

25. The transfer system of claim 24 further comprising a round track and a cart, said track is attached to said reel adjacent to the outer edge of said reel and said cart adapted to travel along said track for assisting hose winding and unwinding.

26. The transfer system of claim 1 further comprising a buoy, said buoy is attached to said first external end and keeps said first external end afloat.

27. The transfer system of claim 26, wherein said buoy further comprising a plurality of thrusters for sailing.

28. A method for fluid transfer between a ship and a second location separated by a body of water, comprising communicating a fluid through a transfer system between a ship and a second location, said transfer system comprising:

a) a reel having a drum;

b) a coupler fixed at said drum, said coupler having a first opening and a second opening, both openings facing a winding direction around said drum;

c) a first hose having a first internal end and a first external end, said first internal end fluidly connected to said coupler at said first opening, and said first external end in fluid communication with said ship;

d) a second hose having a second internal end and a second external end, said second internal end fluidly connected to said coupler at said second opening, and said second external end in fluid communication with said second location;

e) a driving means for applying a torque on said reel opposite to said winding direction, wherein said first hose and said second hose are in tension during fluid transfer.

29. A method for fluid transfer between a ship and a second location separated by a body of water, comprising the steps of:

a) placing a transfer system between said ship and said second location, said transfer system comprising a reel, a first hose and a second hose wound around said reel in a winding direction, said first and second hoses coupled at internal ends with external ends readily accessible;

b) unwinding said first and second hoses simultaneously for establishing a flow path between said ship and said second location with the external end of said first hose in fluid communication with said ship and the external end of said second hose in fluid communication with said second location;

c) transferring a fluid through said flow path wherein said first and second hoses are kept in tension by maintaining a torque on said reel opposite to said winding direction.

30. The method of claim 29, wherein said transfer further comprising a coupler, said coupler having two openings facing said winding direction for fluidly connecting the internal ends of said first and second hoses respectively.

31. The method of claim 29 further comprising adjusting the paid-out length of said first and second hoses for keeping said first and second hoses in tension during fluid transfer.

32. The method of claim 29 further comprising turning said reel opposite to said winding direction and collecting said first and second hoses simultaneously.

33. The method of claim 29 further comprising storing said transfer system at a safe place.

* * * * *